US011178928B2

(12) United States Patent
Lenterman

(10) Patent No.: US 11,178,928 B2
(45) Date of Patent: Nov. 23, 2021

(54) HOODIE CAP VISOR

(71) Applicant: Intro-Tech Automotive, Inc, Chgino, CA (US)

(72) Inventor: Henri Lenterman, Chino Hills, CA (US)

(73) Assignee: Intro-Tech Automotive, Inc, Chino, CA (US)

( * ) Notice: Subject to any disclaimer, the term of this patent is extended or adjusted under 35 U.S.C. 154(b) by 46 days.

(21) Appl. No.: 16/554,079

(22) Filed: Aug. 28, 2019

(65) Prior Publication Data

US 2021/0059341 A1 Mar. 4, 2021

(51) Int. Cl.
*A42B 1/0182* (2021.01)
*A42B 1/0184* (2021.01)

(52) U.S. Cl.
CPC ..... *A42B 1/0182* (2021.01); *A42B 1/0184* (2021.01)

(58) Field of Classification Search
CPC ..... A42B 1/061; A42B 1/062; A42B 1/064; A42B 1/066; A42B 1/0182; A42B 1/084
USPC ..... 2/195.1, 184.5, 175.2, 175.3, 175.6, 2/195.7, 209.12
See application file for complete search history.

(56) References Cited

U.S. PATENT DOCUMENTS 473,427 A * 4/1892 McLoughlin ..... A42B 1/066 2/172
2,344,811 A * 3/1944 Gill ..... A42B 1/067 2/4
3,016,545 A * 1/1962 Donahue ..... A42B 1/062 2/195.5
3,188,654 A * 6/1965 Rafowitz ..... A42B 1/22 2/172
3,346,876 A 10/1967 Hutton
4,839,924 A 6/1989 Laurence
5,125,113 A 6/1992 Yun
5,129,102 A 7/1992 Solo
5,437,062 A 8/1995 Douglas
5,448,778 A 9/1995 Phillips
5,581,807 A 12/1996 Peterson
5,613,246 A 3/1997 Alexander
5,615,413 A 4/1997 Bower
5,689,830 A 11/1997 Pflum
5,901,371 A 5/1999 Lee
5,901,380 A * 5/1999 Mishal ..... A42B 1/067 2/10

(Continued)

OTHER PUBLICATIONS

"Rally Flip Cap" product as displayed on https://twitter.com/rallyflipcap, retrieved Mar. 23, 2019.

*Primary Examiner* — Katherine M Moran
*Assistant Examiner* — Haley A Smith
(74) *Attorney, Agent, or Firm* — The Law Office of Austin Bonderer, PC; Austin Bonderer

(57) ABSTRACT

A bill cap or baseball cap has a crown and a bill as conventional. Additional, the bill cap has an elastic panel affixed at an edge thereof to front and left side edges of the bill. The elastic panel is capable of being flipped between an upward position in which the panel extends upwardly from the bill, and a downward position in which the panel extends downwardly from the bill. In the downward position the panel provides additional shading for the eyes of the wearer and/or privacy for the wearer when viewed from the side, thus providing additional anonymity for the wearer such as from paparazzi.

7 Claims, 6 Drawing Sheets

(56) References Cited

U.S. PATENT DOCUMENTS

| | | | | |
|---|---|---|---|---|
| 5,924,129 | A * | 7/1999 | Gill | A42B 1/062 2/10 |
| 6,044,495 | A | 4/2000 | Ellman et al. | |
| 6,079,052 | A | 6/2000 | Veridiano | |
| 6,173,447 | B1 | 1/2001 | Arnold | |
| 6,237,147 | B1 | 5/2001 | Brockman | |
| 6,237,156 | B1 | 5/2001 | Ellman et al. | |
| 6,473,907 | B1 | 11/2002 | Harwood | |
| 6,641,266 | B1 | 11/2003 | Lazarus | |
| 6,735,782 | B2 | 5/2004 | Park | |
| RE38,774 | E | 8/2005 | Davis | |
| 7,103,920 | B1 | 9/2006 | Otterson | |
| 7,258,436 | B2 | 8/2007 | Heil | |
| 7,325,255 | B2 | 2/2008 | Cunliffe | |
| 7,836,522 | B2 | 11/2010 | Blecha | |
| 8,973,166 | B1 | 3/2015 | Engle | |
| 9,032,555 | B2 | 5/2015 | Kim | |
| 9,078,483 | B1 | 7/2015 | Snyder | |
| 9,107,465 | B2 | 8/2015 | Koh | |
| 9,179,725 | B2 | 11/2015 | Kim | |
| 9,993,042 | B1 | 6/2018 | Miller | |
| 2013/0305431 | A1* | 11/2013 | Mraz | A42B 1/00 2/173 |
| 2013/0318685 | A1* | 12/2013 | Wood | A42B 1/067 2/181 |

* cited by examiner

HOODIE CAP VISOR

CROSS-REFERENCE TO RELATED APPLICATIONS

None.

BACKGROUND OF THE INVENTION

1. Field of the Invention

This invention relates to the field of headware. More particularly, this invention relates to the field of a visor having a flippable hoodie portion that selectably provides increased privacy and sun protection.

2. Description of Related Art

It is vital to the health of the human eye to shield and protect the eye from sunlight, and particularly from the sun's ultraviolet (UV) rays. Chronic exposure to sunlight has been demonstrated to increase the risk of cataracts in humans. See, e.g., National Eye Institute, "New research sheds light on how UV rays may contribute to cataract," Jun. 3, 2014.

Caps and hats for shielding the wearer's eyes from direct sunlight are ubiquitous. Bill caps, sometimes referred to as baseball caps or visor caps, are common. Bill caps have a crown portion that fits over the head of the wearer and a bill attached to the front of the crown. The bill obtains its name from its appearance to a duck's bill. A number of variations on bill caps have been proposed in which additional portions can be selectively attached to the bill, such as by hook-and-loop fasteners or by snapping on, for additional protection from the sun.

U.S. Pat. No. 5,901,371 to Lee discloses a cap having pivoting side visors.

U.S. Pat. No. 5,689,830 to Pflum discloses a cap having a bill that extends and retracts, effectively providing an adjustable-length bill.

U.S. Pat. No. 5,613,246 to Alexander and RE38,774 to Davis disclose caps having a detachable bills.

A number of hats have been proposed having portions that extend downward from the edges of the bill to provide additional protection from the sun.

U.S. Pat. No. 6,641,266 discloses a cap having extra clip-on guards that extend downward on the sides from the bill.

U.S. Pat. No. 3,346,876 to Hutton discloses a cap having a bill or brim, and a continuous band extending downward from the brim.

Additionally, interpersonal friction between celebrities who do not want to be photographed, pursued, or otherwise hounded by paparazzi, and the paparazzi themselves, has increased dramatically in recent years, even leading to violent altercations in some instances. In an extreme and notorious instance in 1997, paparazzi who were purportedly aggressively seeking photographs of Diana, Princess of Wales were blamed at least in part for her death in an automobile accident. Accordingly, there is a need to provide additional privacy to celebrities.

SUMMARY OF THE INVENTION

The present invention is of bill cap that not only provides an ability to quickly, easily, and selectively provide additional shading for the wearer, but also provides additional privacy for the wearer such as when the wearer is a celebrity who does not want to be noticed in public such as by paparazzi.

The present invention is of a cap such as of a bill cap or baseball cap having a bill and an elastic panel that depends downwardly from the periphery of the bill. The downwardly depending panel provides additional privacy and protection from the sun. However because the panel is made of or contains an elastic material, it can be quickly and easily flipped between its downward position and an upward position in which the cap functions as a traditional bill cap.

When flipped down, or in the downward position, the elastic panel lies provides more shading and privacy than a standard bill cap. In this position a wearer can raise or lower his head so that he can see straight forward or at least sufficiently far in front of him to allow him to walk, ride a bicycle, etc. safely, while the side portions of the panel at least partially obscure his eyes as seen from the side, thus providing both shading for his eyes as well as privacy such as from paparazzi.

When flipped up, or in the upward position, the elastic band is no longer within the user's line of sight and thus provides greater visibility, both for the wearer looking outward and for other people looking inward at the wearer's face. The cap might be worn, for example, by an outdoorsman who wants to be able to flip the panel downward to provide maximum shading and protection from the sun, and then flip the panel back into its original configuration when the shading provided by a regular bill cap will suffice. The cap might also be worn, for example, by a celebrity who nominally wants the shading provided by a regular baseball cap, but also wants to be able to quickly flip the panel downward for extra privacy so that she is less recognizable on the street.

In this way the elastic panel functions as a positionable hood for the cap. The overall function of the cap is similar to that of a "hoodie" jacket, in that the wearer can quickly and easily pull the panel down for greater privacy/reduced recognizability. The inventor has thus coined the name "hoodie cap visor" for this invention.

The panel can be made of an elastic band, or can be a fabric panel that has one or more elastic chords attached or sewn to it such as at the outermost edge of the panel. The panel can be of a uniform width, or can be narrower at the front portion thereby providing greater side shielding than front shielding. The panel could even comprise two separate panels at the sides and partially to the front, but not connected at the front.

In one aspect therefore, the invention is of a bill cap for providing shade and for selectively providing additional shade and privacy to a wearer. The bill cap includes a crown adapted to be placed over a top of the wearer's head, the crown having at least a front portion, a left side portion, and a right side portion. The bill cap further includes a bill that extends generally forward from the crown front portion, extending far enough forward to provide shading from the sun for eyes of the wearer, and an elastic panel attached to the bill's front, left side, and right side edges. The panel can be elastic either by way of its being all elastic, or by way of its having one or more elastic chords or bands captured within the band, sewn to it, or otherwise affixed to it. The elastic panel may be flipped between a first and upper position and a second and lower position. In its upper position, the panel extends generally upwardly from the edges of the bill, and the bill cap functions much like a traditional bill cap. It its lower position, the panel extends generally downwardly from the edges of the bill, thus providing additional shading to the eyes of the wearer against sunlight, and also additional privacy that makes it more difficult for others to recognize the wearer, especially from the side.

Exemplary embodiments of the invention will be further described below with reference to the drawings, in which like numbers refer to like parts. The drawing figures might not be to scale, and certain components may be shown in generalized or schematic form and identified by commercial designations in the interest of clarity and conciseness.

DETAILED DESCRIPTION OF THE PREFERRED EMBODIMENTS

Bill caps, which the present invention may be applied to, are sometimes called baseball caps or visor caps. The bill extends far enough forward to provide shading from the sun for eyes of the wearer. Typically the bill of a bill cap has a convex curvature in it as one traverses the bill laterally from left to right, although some bill caps have flat bills. The present invention applies equally to bill caps having curved bills or flat bills.

Figure 1:
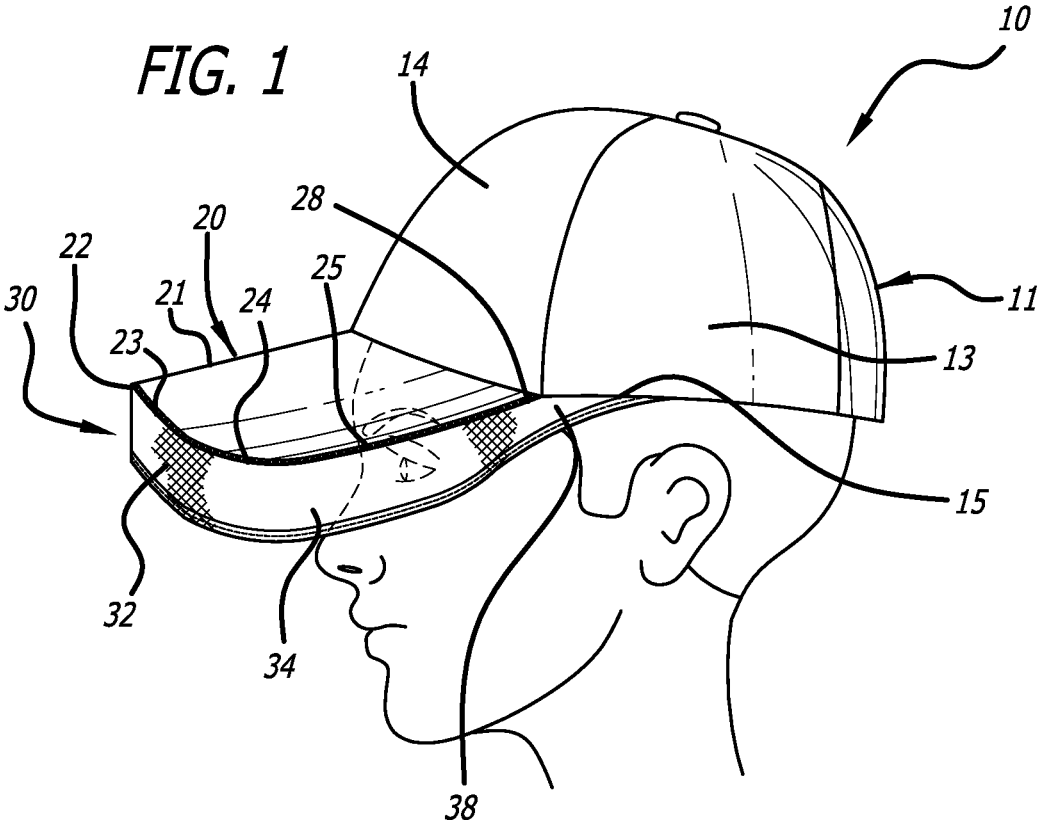
FIG. 1 is a top left perspective view of a person wearing the bill cap according to a first embodiment of the present invention, with the elastic panel flipped into its downward position for greater shade and privacy.

FIG. 1 is a top left perspective view of a person wearing the bill cap 10 according to a first embodiment of the present invention, with the elastic panel 30 flipped into its downward position for greater shade and privacy. Bill cap 10 includes a crown 11 which is adapted to fit over a top of a head of a wearer. Crown 11 includes a right side portion 12 (FIG. 3), a left side portion 13, and a front portion 14. A bill 20 is attached to, and extends generally forward from, the crown front portion 14. Bill 20 provides shading against sunlight for the wearer's eyes. The structure described in this paragraph is conventional so far.

Unconventionally, bill cap 10 also has an elastic panel 30 attached to the bill at the bill's right edge 21, curved right front corner 22, front edge 23, curved left front corner 24, and left edge 25, and in this embodiment elastic panel 30 extends past the bill's rearmost portion 28. The term "elastic" as used herein and in the claims appended hereto is used in its broadest sense to refer to elastic properties without regard to any particular chemical composition(s), weave(s), or the like. The left side 34 of panel 30 is attached to the bill's left edge 25; the right side 36 of panel 30 is attached to the bill's right edge 21; and the front portion 32 of panel 30 is attached to the bill's front edge 23. Panel 30 extends generally downwardly from the bill's front and sides. Preferably panel 30 is at least 1 cm wide and thus extends down at least 1 cm, and preferably is at least 2 cm wide and thus extends down at least 2 cm, from the immediately adjacent corresponding portions of bill 20. Panel 30 could be more than 1 inch wide.

In this position panel 30 provides additional shade and privacy to the wearer, beyond what a corresponding conventional bill cap would provide. In this position the side portions 34, 36 of panel 30 obscure, or at least partially obscure, the eyes of the wearer, thus making it more difficult for people to see the eyes of the wearer and hence recognize him from the side such as directly from the side. In this position the wearer can tilt his head at a desired angle so that he can see directly forward, or at least can see far enough forward to safely walk, bicycle, or engage in other activities, while his eyes remained obscured from the side. Celebrities who are walking on the sidewalk, doing their shopping, riding bicycles with their children, or engaging in other activities, may find this additional privacy highly desirable in order to avoid being recognized by people generally, and more specifically from being recognized and hence bothered by paparazzi or even by overly enthusiastic fans.

In this embodiment the side portions 34, 36 of panel 30 have a rear portion 38 that extends rearward beyond the rearmost extent 28 of bill 20.

Figure 2:
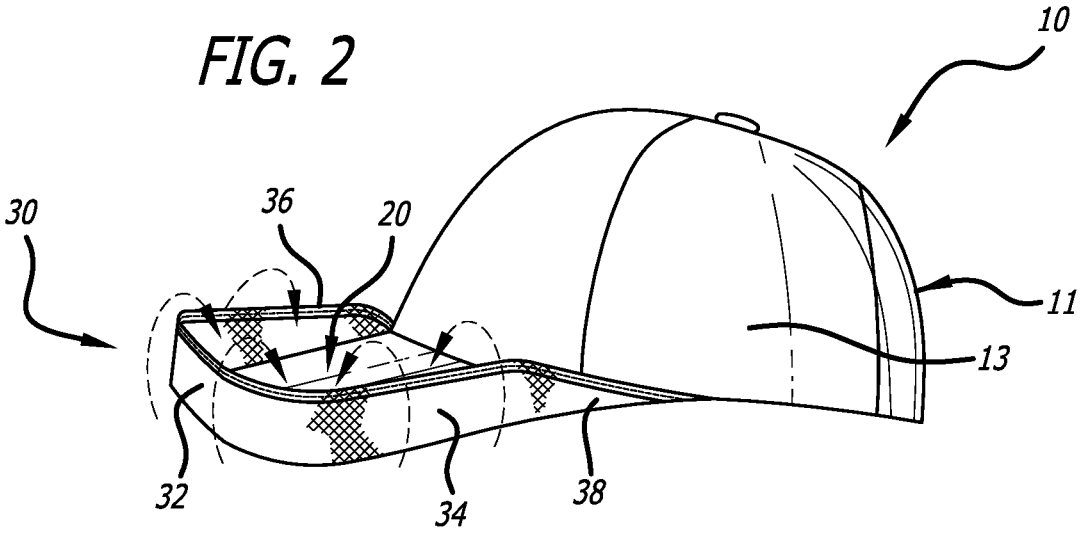
FIG. 2 is a top left perspective view of the bill cap of FIG. 1 with the elastic panel flipped into its upward position for less shade and privacy.

FIG. 2 is a top left perspective view of the bill cap 10 of FIG. 1 with the elastic panel 30 having been flipped into its upward position for less shade and privacy. Elastic panel 30 stretches so that it can be successful flipped between its lower position as shown in FIG. 1 and its upper position as shown in FIG. 2. In this position, from the wearer's perspective bill cap 10 performs essentially like a conventional bill cap. Panel 30 is out of the user's field of vision, or almost entirely out of the user's field of vision.

In its upward and downward positions, elastic panel 30 is in its nominally unstretched state, i.e. without significant elastic tension in it. When being moved between its upward and downward positions, however, the elastic property of elastic panel 30 causes the panel to transition first from a state without significant elastic tension, through a state of elastic tension, then back again to a state without significant elastic tension in which it is relaxed relative to its stretched state. That is, panel 30 gets stretched by the flipping action. The elastic property of elastic panel 30 can be provided either by elastic panel 30 being made entirely of elastic material such as a unitary band of elastic fabric, or it can be a fabric panel that has one or more elastic bands or chords attached or sewn to it such as at the outermost edges of the panel. The stretching of the panel as it is flipped between its upward and its downward positions, means that upward and downward positions are both stable positions; the panel will not change between those two stable positions due to gravity, wind, or similar conditions.

Advertising, a company logo, a creative design, or other indicia could be provided on the portion of panel 30 that faces outward when panel 30 is in its upward (flipped-up)

position, and/or on the portion of panel 30 that faces outward when panel 30 is in its downward (flipped-down) position.

Figure 3:
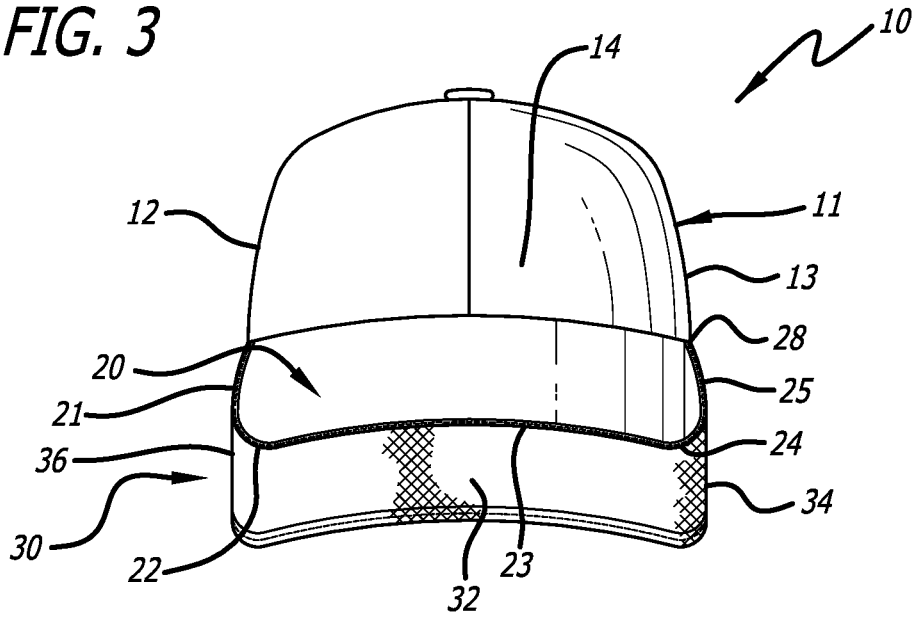
FIG. 3 is a front elevation view of the bill cap of FIG. 1.
Figure 4:
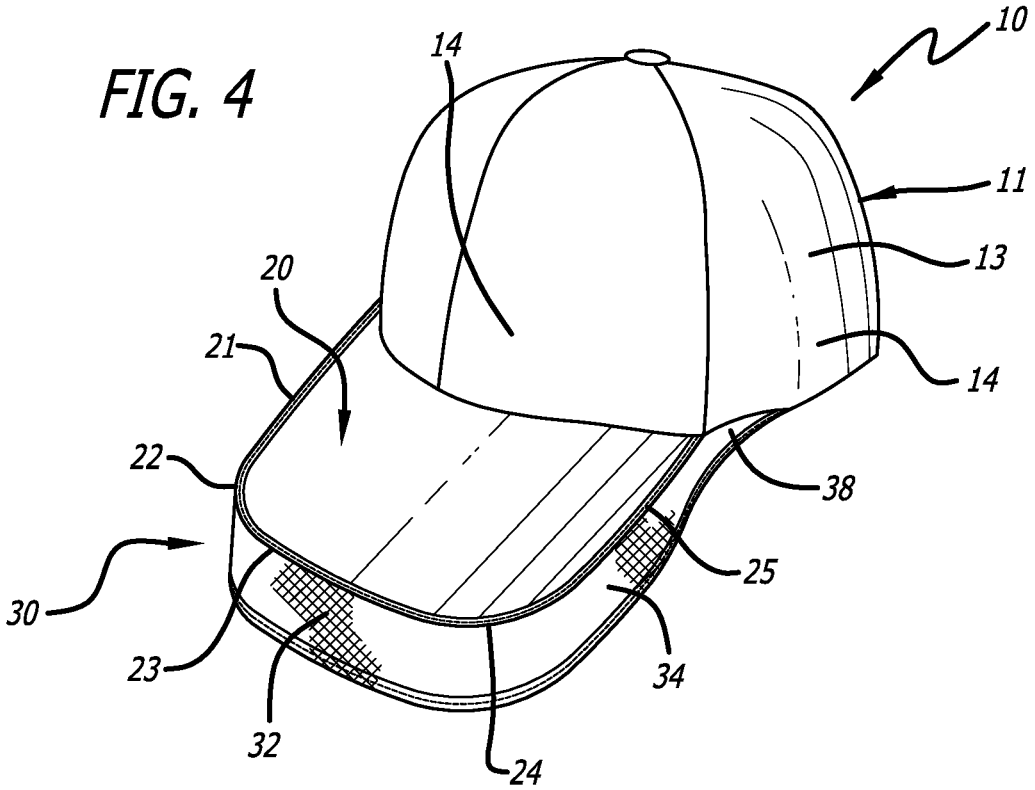
FIG. 4 is a top left perspective view of the bill cap of FIG. 1.

FIG. 3 is a front elevation view of the bill cap 10 of FIG. 1 without the wearer, and FIG. 4 is a top left perspective view thereof.

Figure 5:
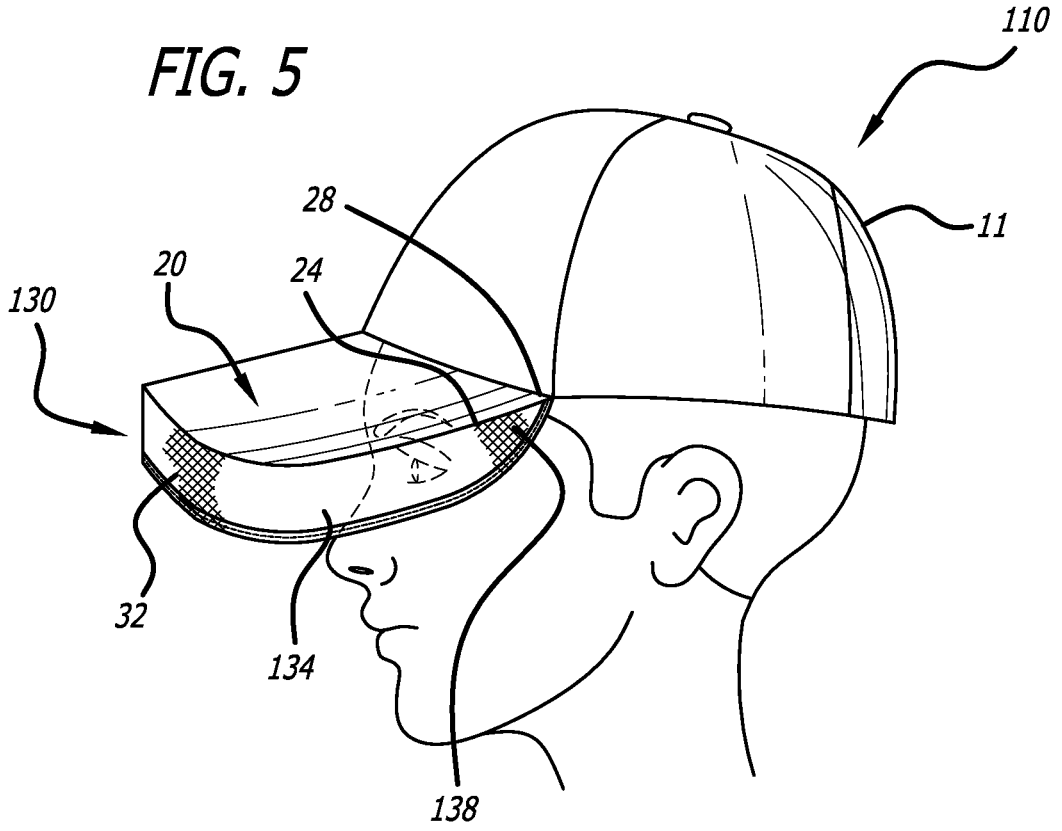
FIG. 5 is a top left perspective view of a user wearing a bill cap according to a second embodiment of the present invention, with the elastic panel flipped into its downward position for greater shade and privacy.

FIG. 5 is a top left perspective view of a user wearing a bill cap 110 according to a second embodiment of the present invention, with the elastic panel 130 flipped into its downward position for greater shade and privacy. In this embodiment the side portions 134, 136 of elastic panel 130 do not extend rearwardly past a rearmost extent of bill 20. That is, rearmost portion 138 of panel 130 extends only to the rearmost extent 28 of bill 20 and no further. Otherwise this embodiment functions similarly to the embodiment of FIG. 1.

Figure 6:
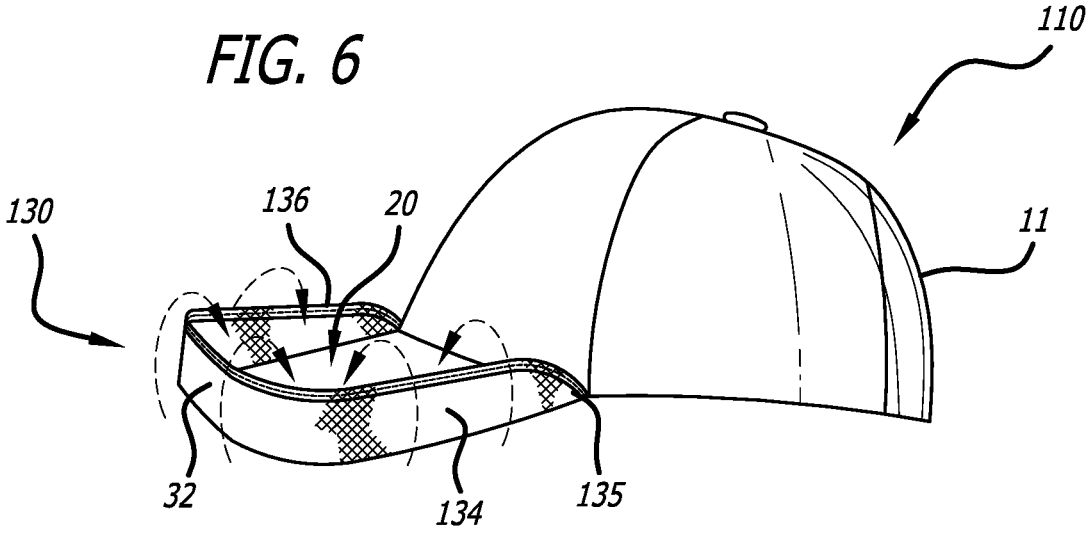
FIG. 6 is a top left perspective view of the bill cap of FIG. 5 with the elastic panel flipped into its upward position for less shade and privacy.

FIG. 6 is a top left perspective view of the bill cap 110 of FIG. 5 with the elastic panel 130 flipped into its upward position for less shade and privacy. As can be seen, the flipping between the upward position and downward position is completed by rotating the elastic panel 130 about the bill 20.

Figure 7:
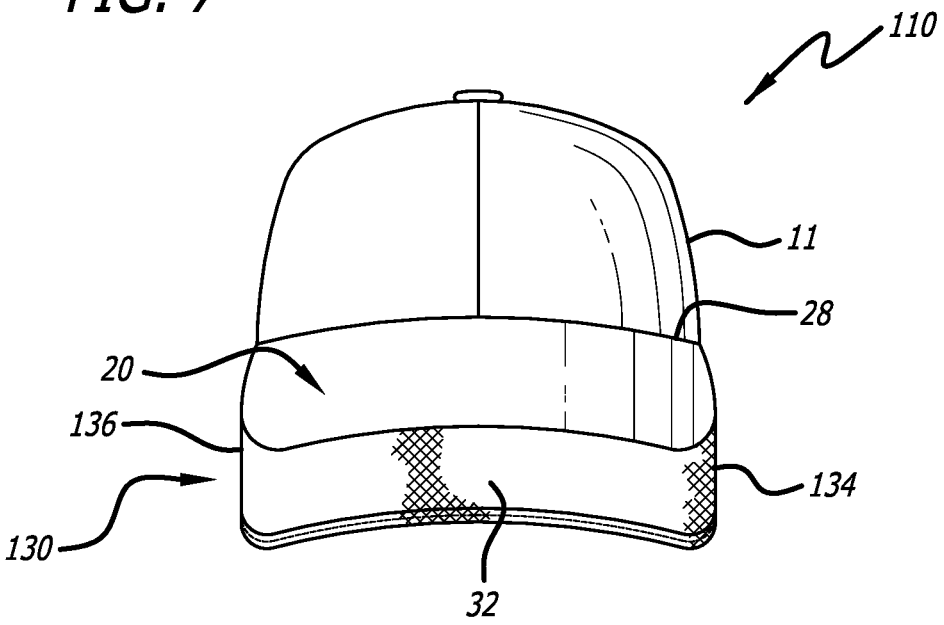
FIG. 7 is a front elevation view of the bill cap of FIG. 5.
Figure 8:
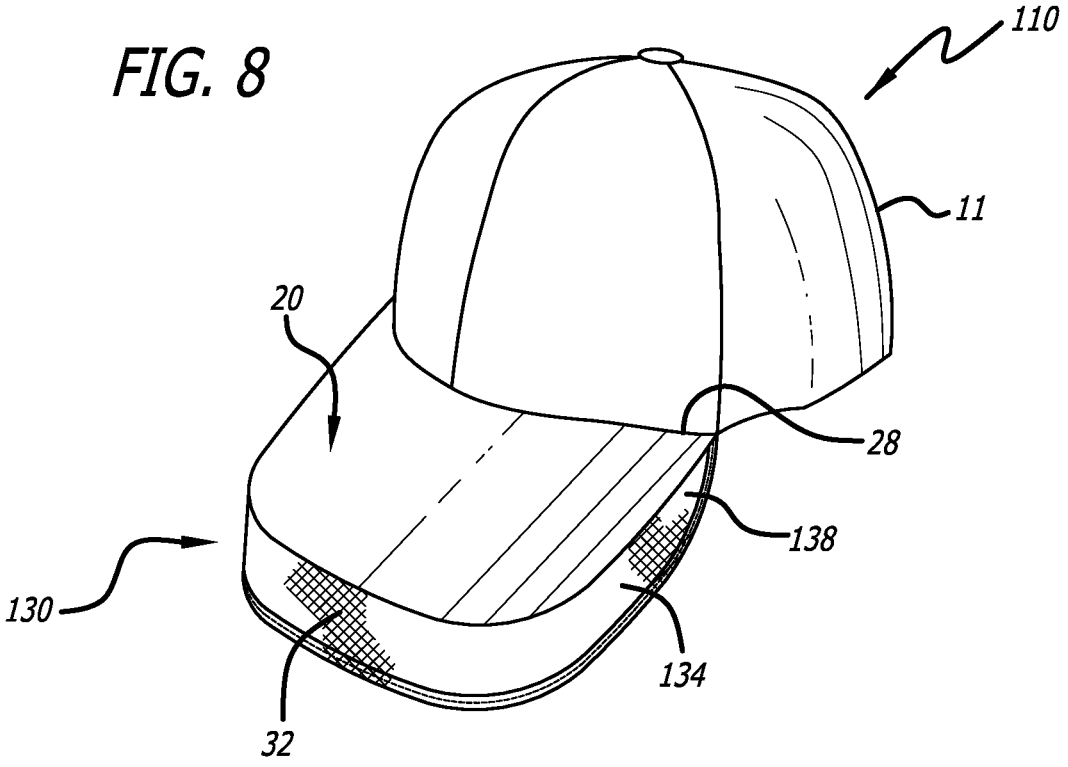
FIG. 8 is a top left perspective view of the bill cap of FIG. 5.

FIG. 7 is a front elevation view of the bill cap 110 of FIG. 5 without the wearer, and FIG. 8 is a top left perspective view thereof.

Elastic panel 30 can be of a uniform width, or can be narrower at the front portion thereby providing greater side shielding than front shielding. The panel could even comprise two separate panels at the sides, over the corners 22, 24, and partially to the front edge 23, but not connected at the front.

Figure 9:
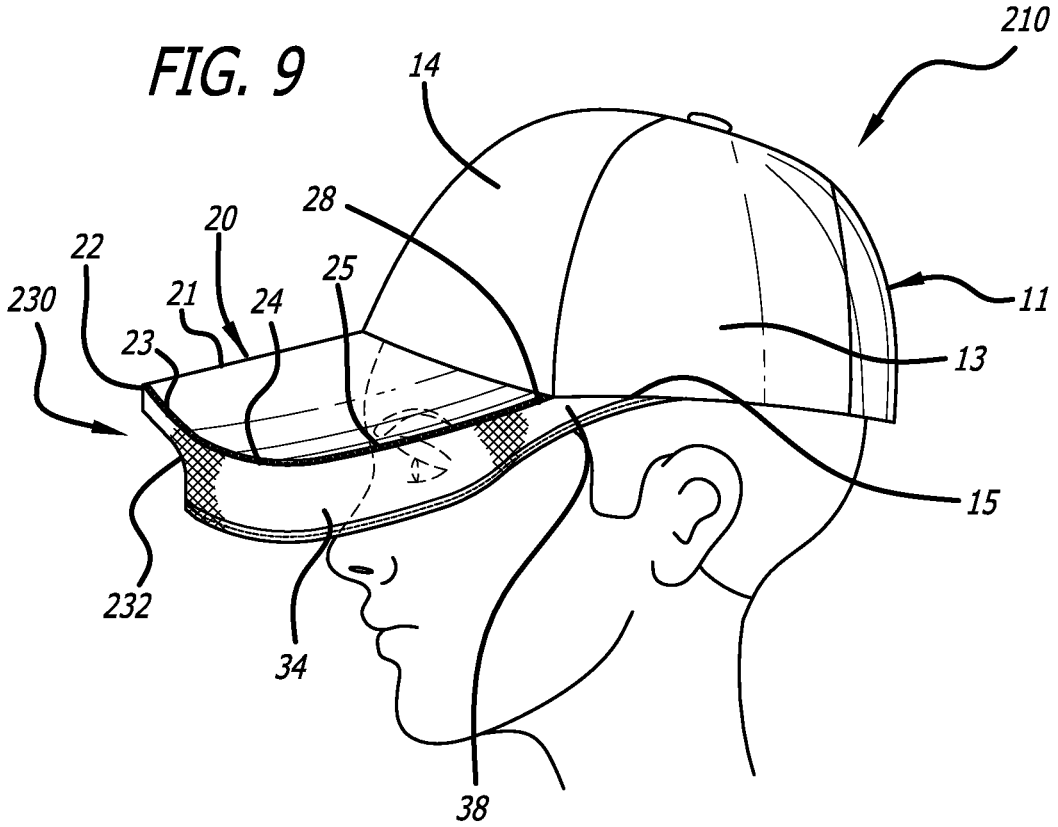
FIG. 9 is a top left perspective view of user wearing a bill cap according to a third embodiment of the present invention, with the elastic panel flipped into its downward position for greater shade and privacy.

FIG. 9 is a top left perspective view of user wearing a bill cap 210 according to a third embodiment of the present invention, with the elastic panel 230 flipped into its downward position for greater shade and privacy. In this embodiment elastic panel 230 is of non-uniform width. More specifically, elastic panel 230 is narrower at its front portion 232 than it is at its left and right side portions 234, 236. In this embodiment when the wearer flips down elastic panel 230, his forward vision is not obscured as much as with the prior embodiments. Thus, the wearer does not need to tilt his head as far back in order to still see forward for safety or other reasons, while still keeping his eyes obscured or at least partially obscured from the side. More generally, elastic panel 230 could even comprise two separate panels that extend from the side edges of bill 20 and at least partially onto the front and left side corner edges 22, 24 of the bill so that they can be elastically flipped, but without any panel front portion 232 between them.

Figure 10:
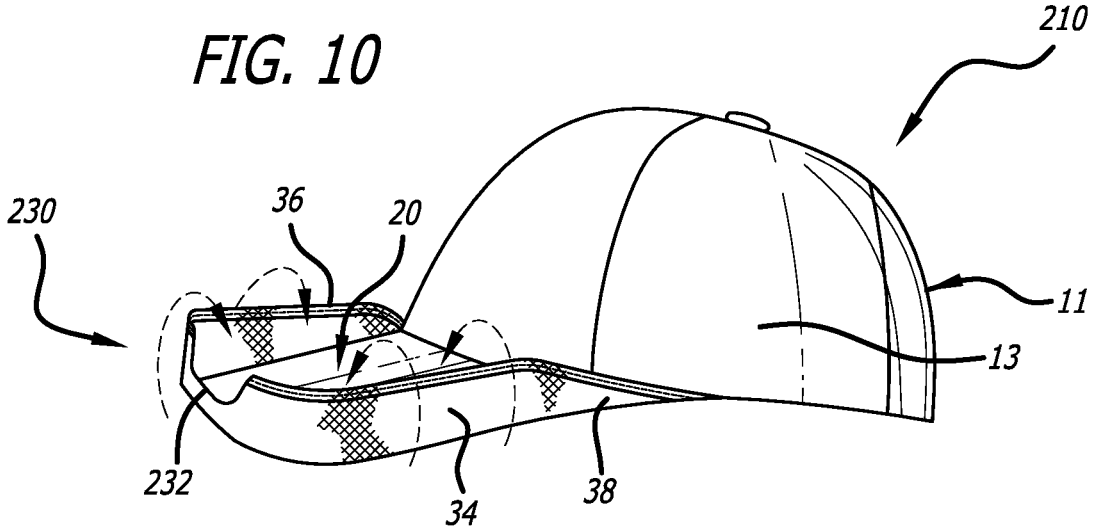
FIG. 10 is a top left perspective view of the bill cap of FIG. 9 with the elastic panel flipped into its upward position for less shade and privacy.

FIG. 10 is a top left perspective view of the bill cap 210 of FIG. 9 with the elastic panel 230 flipped into its upward position for less shade and privacy.

Figure 11:
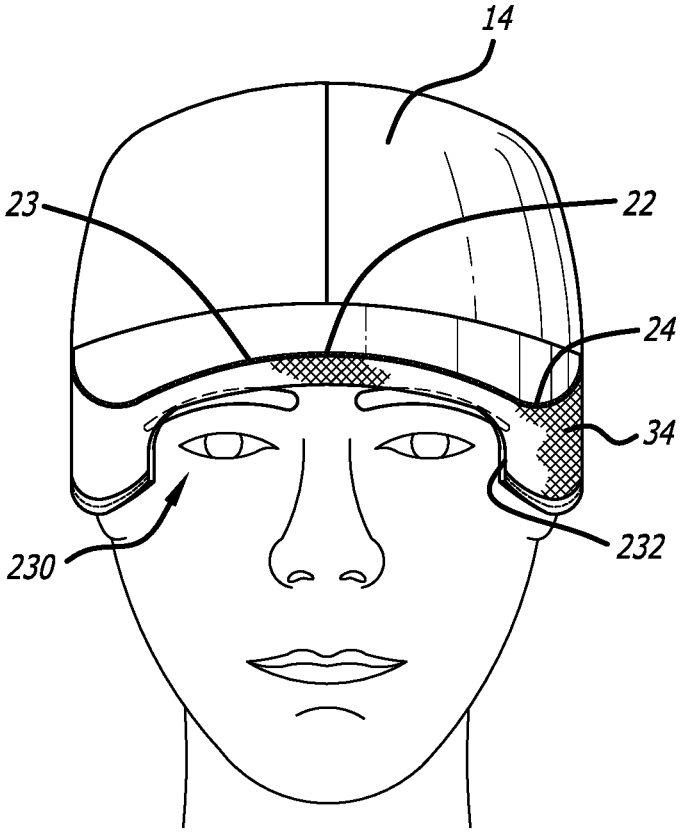
FIG. 11 is a front elevation view of the bill cap and wearer of FIG. 9.

FIG. 11 is a front elevation view of the bill cap and wearer of FIG. 9. As seen perhaps best in this view, the wearer flipping the elastic panel 230 up or down does not change the wearer's field of vision drastically, but doing so does change whether the wearer's eyes can be seen from the side, including from an angle that is somewhat forward from straight to the side.

As in the other embodiments disclosed, sides 34, 36 of panel 230 not only provide selectable privacy, but also provide selectable enhanced shading from the sun, functioning similar to side shields sometimes called "side blinders" on glacier glasses. The easier that it is for a wearer to selectively obtain protection from the sun and its harmful UV rays such as by a quick flip of the elastic panel 230, the more likely that the wearer is to take advantage of such additional protection. Accordingly, the invention can be expected to provide increased safety from sun damage to the eyes including from cataracts.

An improved bill cap is thus provided that functions as a regular bill cap (FIGS. 2, 6, and 10), but in which a user can quickly and easily flip a panel 30/130/230 down (FIGS. 1, 5, and 9, and 11) to provide additional shading and privacy when desired and hence additional eye safety.

It will be understood that the terms "generally," "approximately," "about," "substantially," and "significantly" as used within the specification and the claims herein allow for a certain amount of variation from any exact dimensions, measurements, and arrangements, and that those terms should be understood within the context of the description and operation of the invention as disclosed herein.

All features disclosed in the specification, including the claims, abstract, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

It will be appreciated that the term "present invention" as used herein should not be construed to mean that only a single invention having a single essential element or group of elements is presented. Similarly, it will also be appreciated that the term "present invention" encompasses a number of separate innovations which can each be considered separate inventions. Although the present invention has thus been described in detail with regard to the preferred embodiments and drawings thereof, it should be apparent to those skilled in the art that various adaptations and modifications of the present invention may be accomplished without departing from the spirit and the scope of the invention. Accordingly, it is to be understood that the detailed description and the accompanying drawings as set forth hereinabove are not intended to limit the breadth of the present invention, which should be inferred only from the following claims and their appropriately construed legal equivalents.

I claim:

1. A bill cap, comprising: a crown, comprising at least a front portion, a left side portion, and a right side portion; a bill that extends generally forward from the front portion, the bill having a front edge, a left edge, and a right edge; a panel attached to the bill at the bill front edge, the bill left edge, and the bill right edge; wherein: the panel is configured to rotate about the bill front edge, the bill left edge, and the bill right edge between an upper position and a lower position; in said lower position, the panel extends generally downwardly from the bill front edge, the bill left edge, and the bill right edge, and in said upper position, the panel extends generally upwardly from the bill front edge, the bill left edge, and the bill right edge, wherein the panel comprises a unitary band of elastic fabric, and wherein the panel is at least 2 cm wide such that in the lower position the panel extends at least 2 cm down from an immediately adjacent corresponding portion of the bill.

2. The bill cap of claim 1 wherein, when the panel is rotated between its said upper position and a said lower position, the elastic fabric is stretched to a stretched state, and when the panel reaches said upper position or said lower position after being rotated thereto, the elastic fabric is relaxed relative to its the stretched state during said rotating.

3. The bill cap of claim 1 wherein the panel is of a width such that when the bill cap is worn, a wearer can tilt his head to an angle and can see directly horizontally forward; and at the same time an observer who is directly to a side of the wearer cannot see the wearer's eyes is substantially inhibited from being able to identify the wearer, thereby providing increased privacy to the wearer.

4. The bill cap of claim 1 wherein a rearmost extent of the panel extends only to a rearmost extent of the bill.

5. The bill cap of claim 1 wherein a rearmost extent of the panel extends more rearward than a rearmost extent of the bill and is attached at a lower edge of the crown.

6. The bill cap of claim 1 wherein said panel varies in width.

7. The bill cap of claim 1 wherein said panel is wider at left and right sides thereof than it is at a front thereof.

* * * * *